US010760231B1

(12) United States Patent
Klose

(10) Patent No.: US 10,760,231 B1
(45) Date of Patent: Sep. 1, 2020

(54) INFLATABLE WATER BARRIER ASSEMBLY

(71) Applicant: Andrew Klose, Linwood, NJ (US)

(72) Inventor: Andrew Klose, Linwood, NJ (US)

( * ) Notice: Subject to any disclaimer, the term of this patent is extended or adjusted under 35 U.S.C. 154(b) by 0 days.

(21) Appl. No.: 16/527,186

(22) Filed: Jul. 31, 2019

(51) Int. Cl.
*E02B 3/10* (2006.01)
*E02B 3/12* (2006.01)

(52) U.S. Cl.
CPC ..... *E02B 3/108* (2013.01); *E02B 3/127* (2013.01)

(58) Field of Classification Search
CPC combination set(s) only.
See application file for complete search history.

(56) References Cited

U.S. PATENT DOCUMENTS 4,692,060 A 9/1987 Jackson, III
6,551,025 B2 4/2003 Dery
D504,522 S 4/2005 Kendall
7,491,016 B2 2/2009 Baruh
10,036,134 B2 7/2018 Abeles
2004/0047688 A1 3/2004 Clement
2007/0217868 A1* 9/2007 Beidle ..... E02B 3/06 405/115
2010/0215436 A1* 8/2010 Johnson ..... E02B 3/108 405/110
2012/0057935 A1* 3/2012 Lifton ..... E01F 15/086 405/65
2012/0207545 A1 8/2012 Bouchard
2016/0319504 A1* 11/2016 Vickers ..... E02B 3/108
2017/0051464 A1* 2/2017 Andersen ..... E02B 3/108

* cited by examiner

*Primary Examiner* — Kyle Armstrong

(57) ABSTRACT

An inflatable water barrier assembly includes a plurality of boundary units. Each of the boundary units can be linked together on a support surface to define a boundary around a selected area to inhibit flood water from entering the selected area. Each of the boundary units has a lower portion that is fluidly discrete from an upper portion. The lower portion is fillable with water to weighing down the boundary units. The upper portion of each of the boundary units is inflatable with air to inhibit the flood water from passing thereover. A plurality of anchors is engages a respective one of the boundary units. Each of the anchors penetrates a support surface to inhibit the respective boundary unit from being moved by flood water.

12 Claims, 7 Drawing Sheets

INFLATABLE WATER BARRIER ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to barrier devices and more particularly pertains to a new barrier device for protecting selected areas from flood waters.

(2) Description of Related Art Including Information Disclosed Under 37 CFR 1.97 and 1.98

The disclosure relates to barrier devices.

BRIEF SUMMARY OF THE INVENTION

An embodiment of the disclosure meets the needs presented above by generally comprising a plurality of boundary units. Each of the boundary units can be linked together on a support surface to define a boundary around a selected area to inhibit flood water from entering the selected area. Each of the boundary units has a lower portion that is fluidly discrete from an upper portion. The lower portion is fillable with water to weighing down the boundary units. The upper portion of each of the boundary units is inflatable with air to inhibit the flood water from passing thereover. A plurality of anchors is engages a respective one of the boundary units. Each of the anchors penetrates a support surface to inhibit the respective boundary unit from being moved by flood water.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
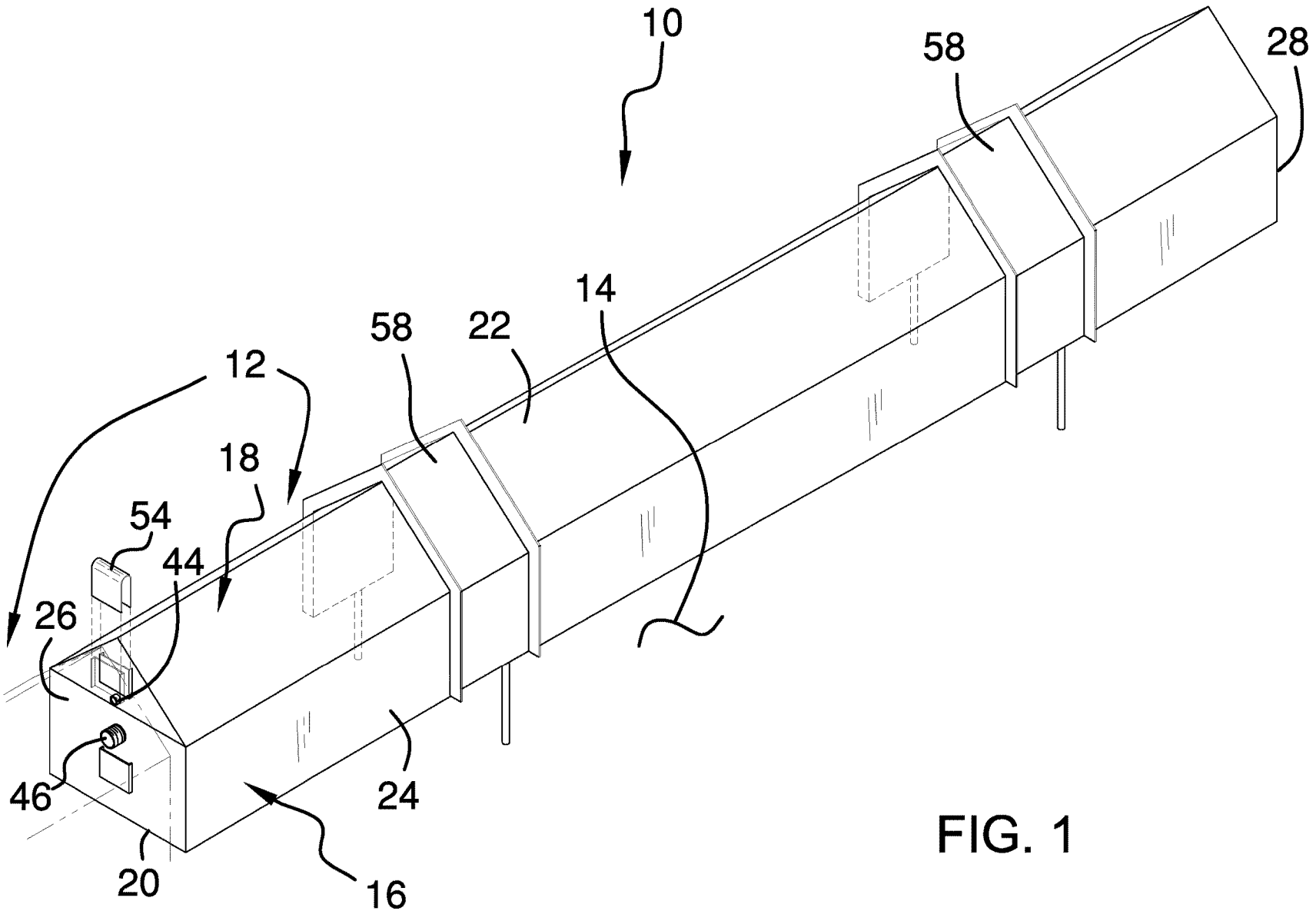
FIG. 1 is a perspective view of an inflatable water barrier assembly according to an embodiment of the disclosure.
Figure 2:
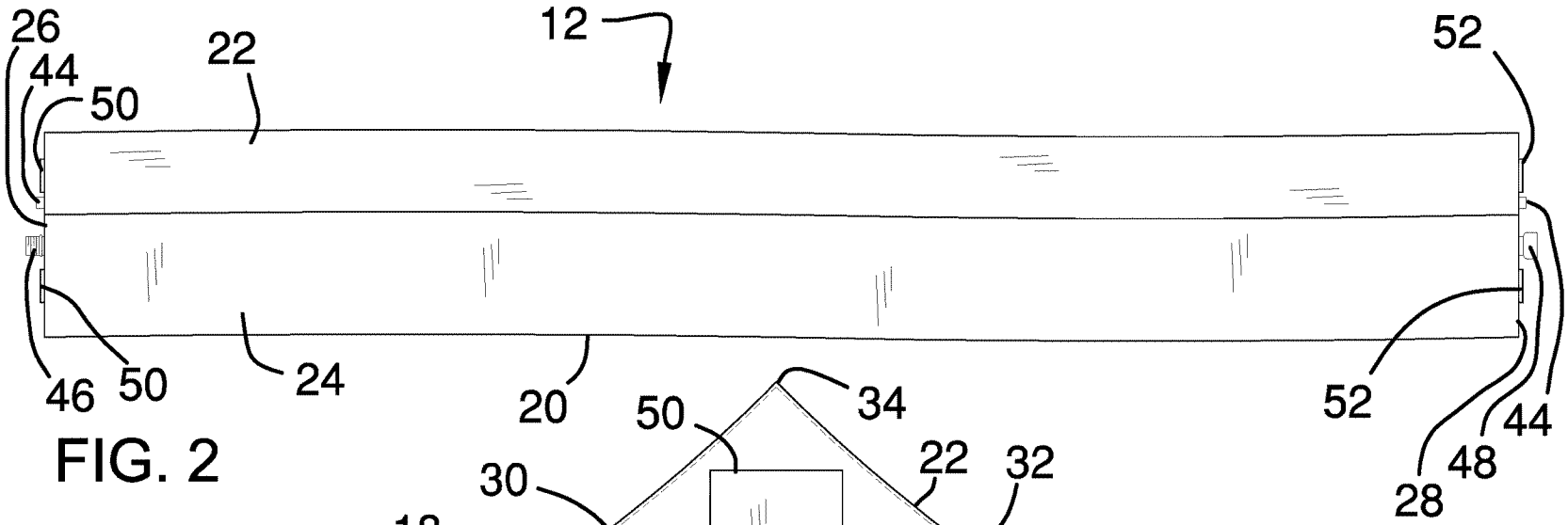
FIG. 2 is a front view of an embodiment of the disclosure.
Figure 3:
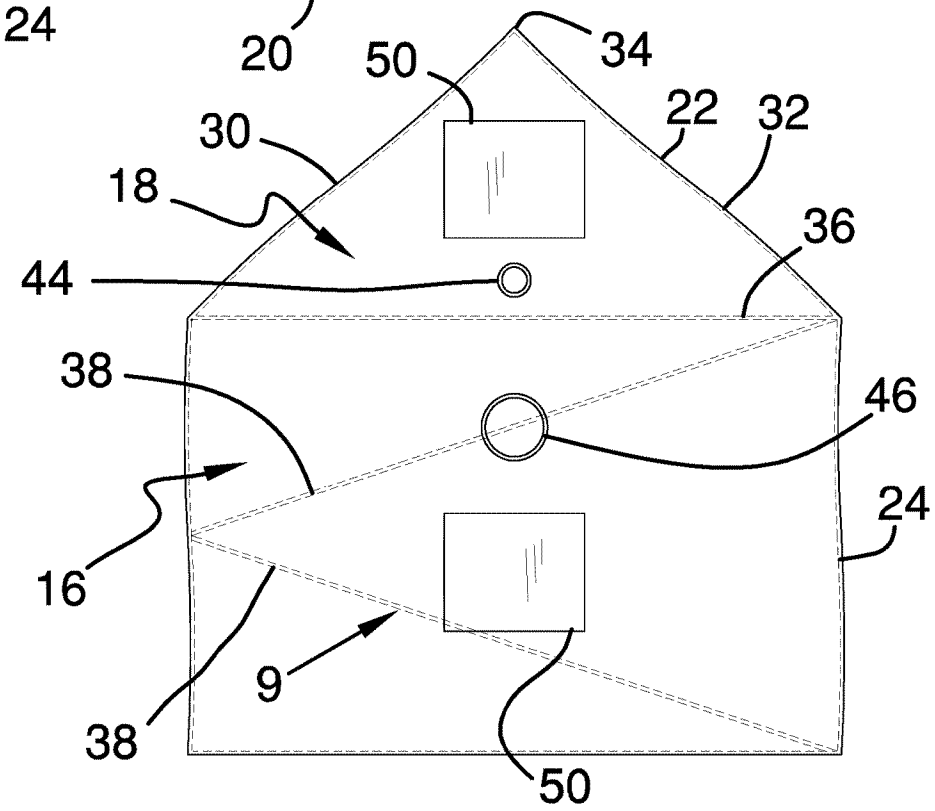
FIG. 3 is a right side view of an embodiment of the disclosure.
Figure 4:
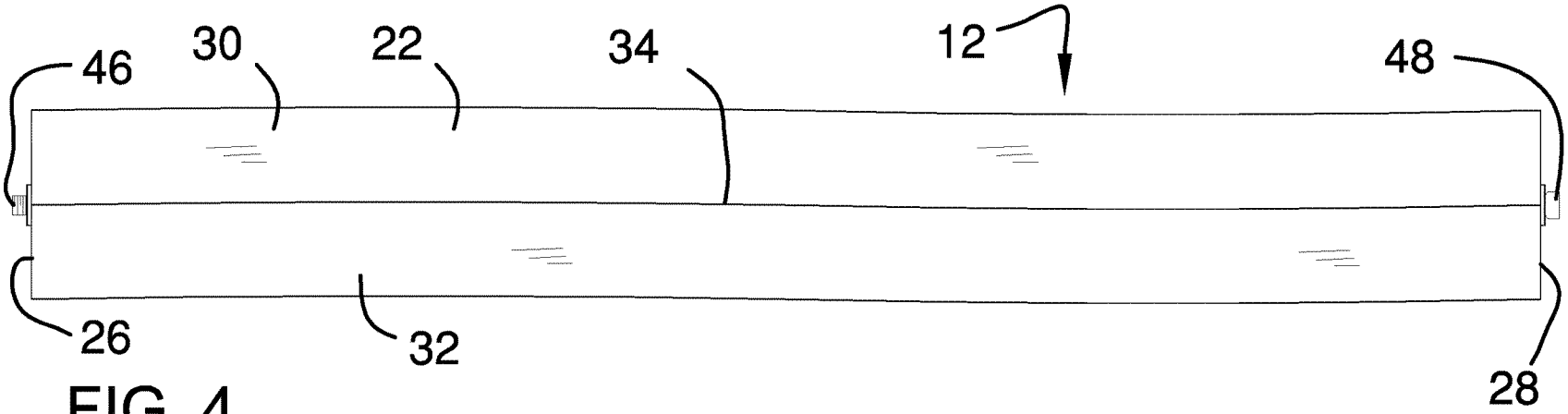
FIG. 4 is a top view of an embodiment of the disclosure.
Figure 5:
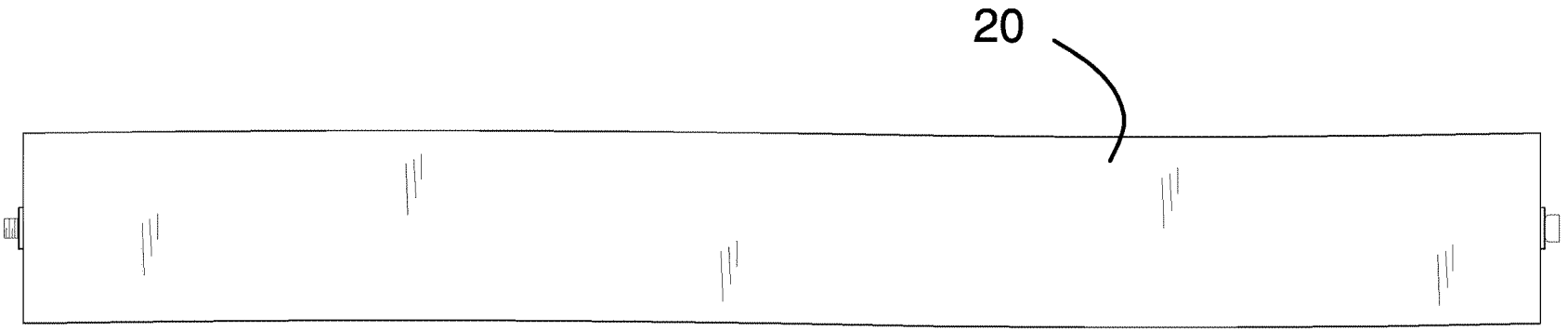
FIG. 5 is a bottom view of an embodiment of the disclosure.
Figure 6:
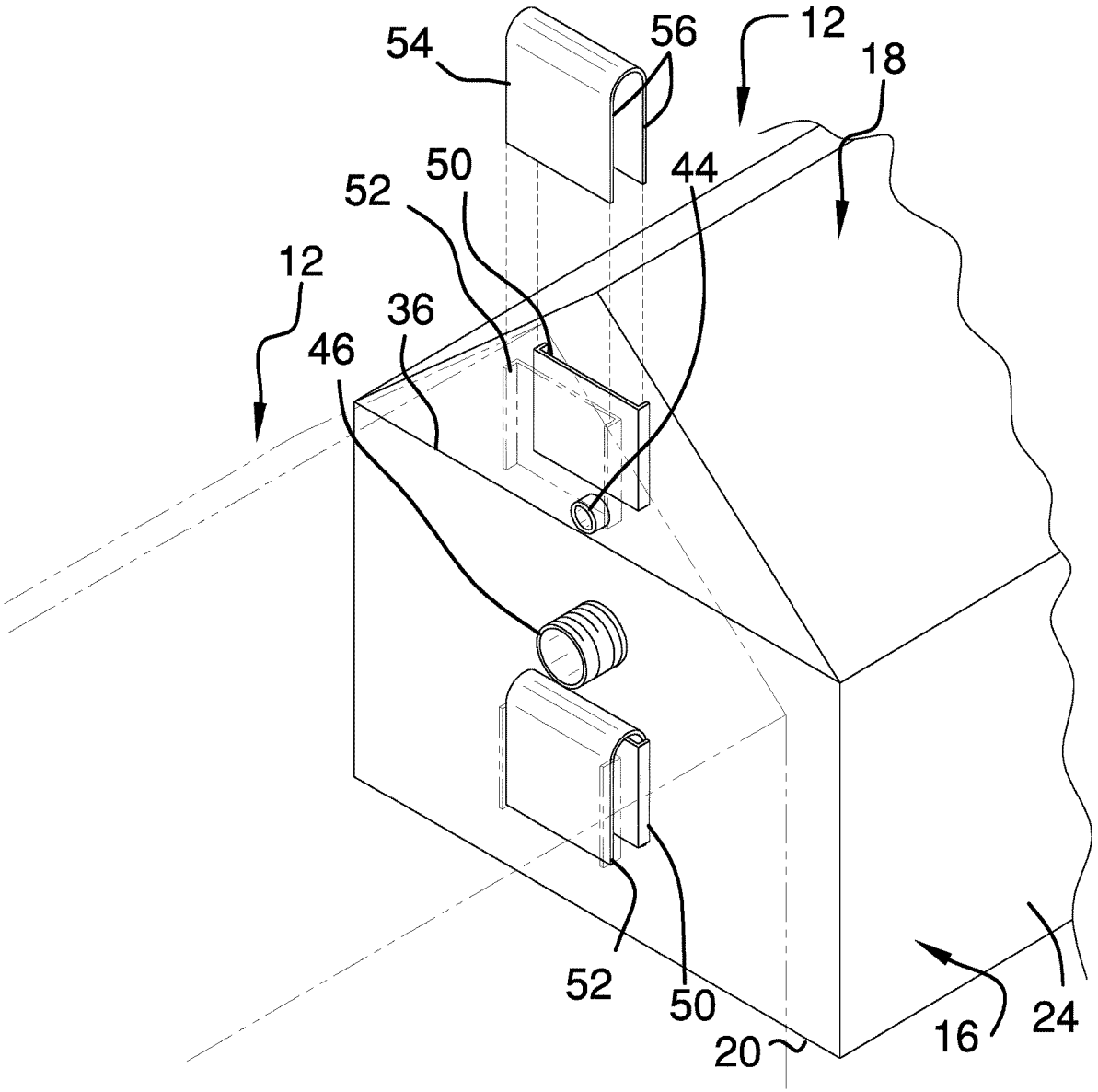
FIG. 6 is a right side perspective view of an embodiment of the disclosure showing a pair of boundary units being linked together.
Figure 7:
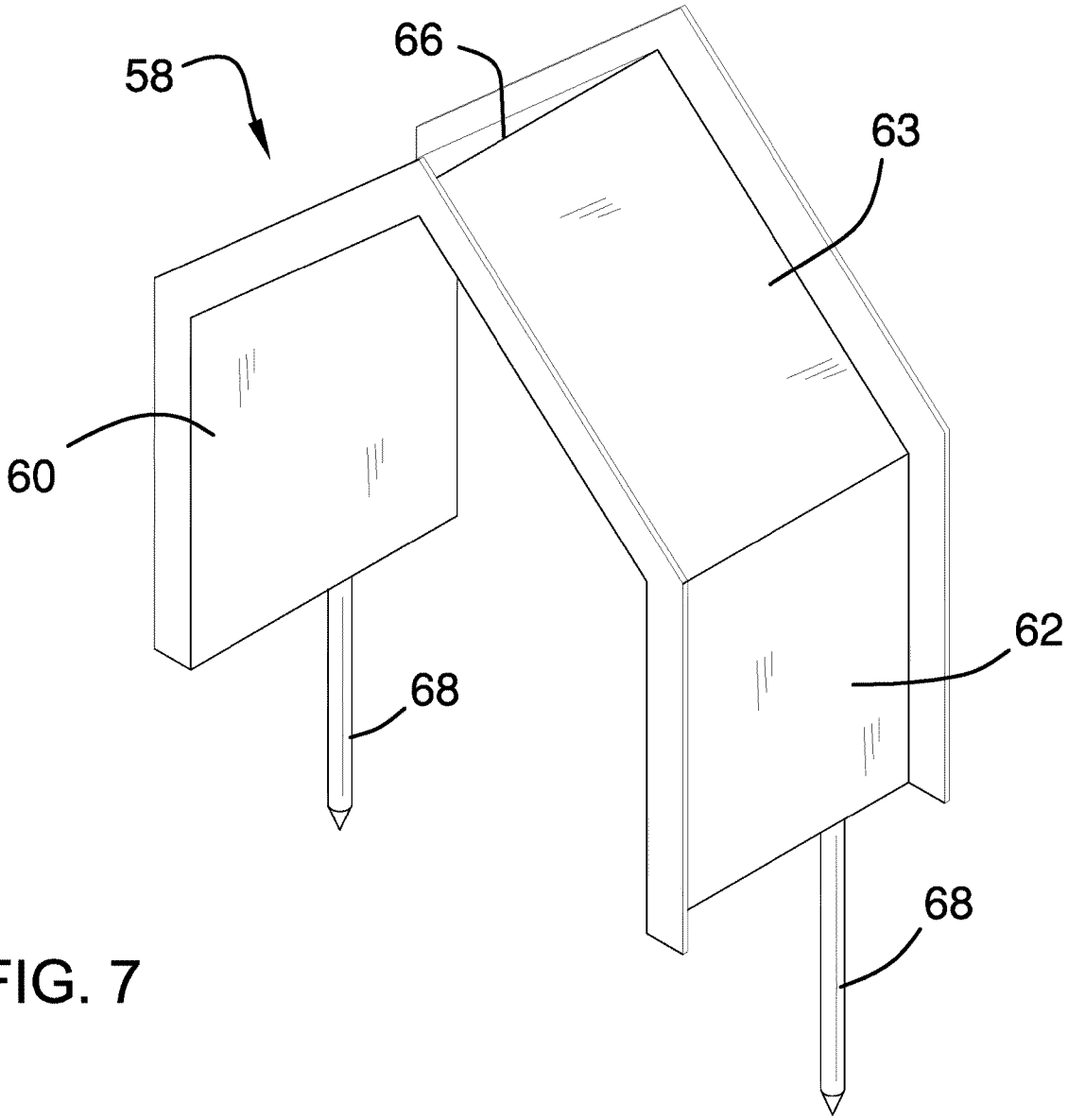
FIG. 7 is a perspective view of an anchor of an embodiment of the disclosure.
Figure 8:
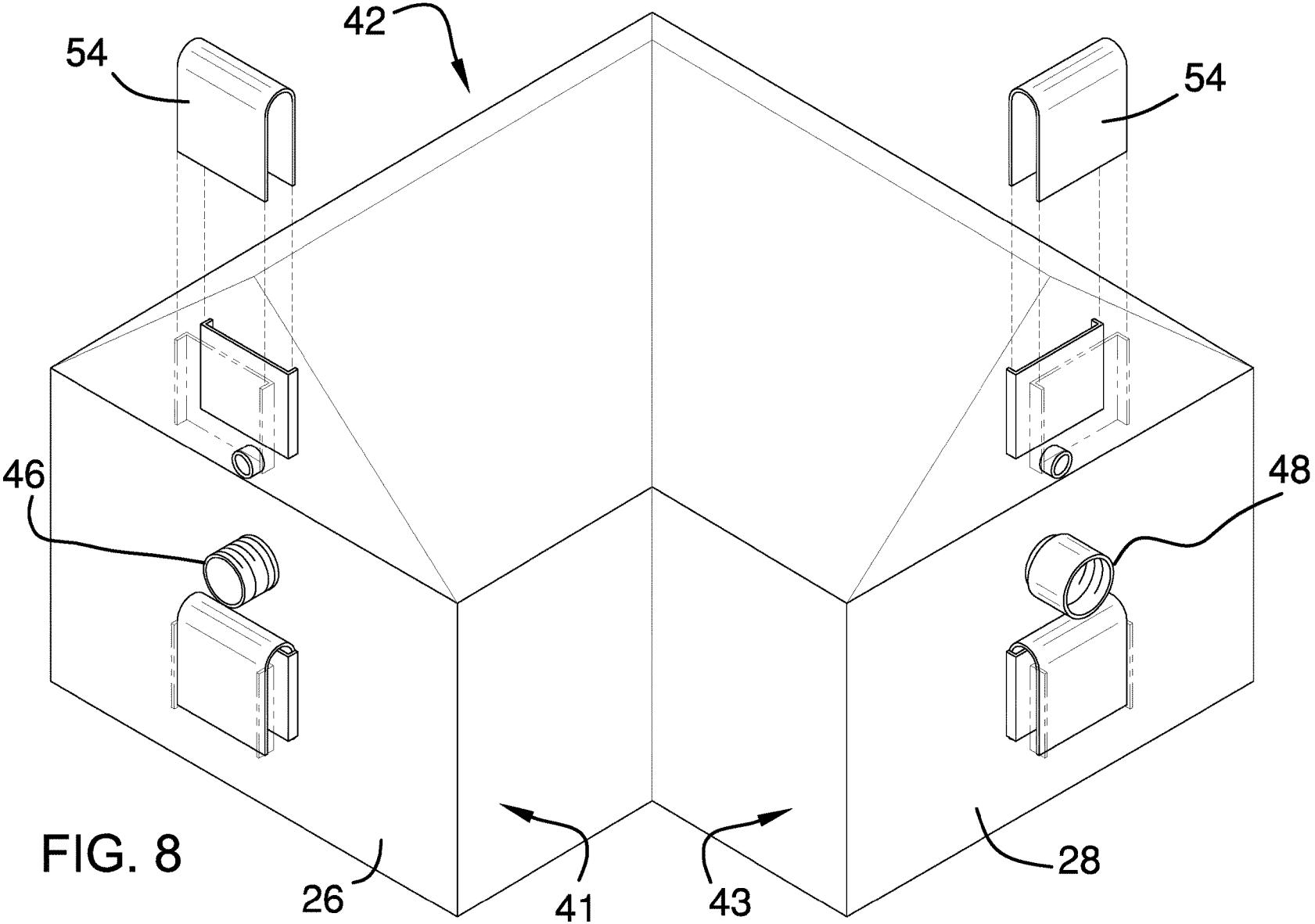
FIG. 8 is a perspective view of a corner unit of an embodiment of the disclosure.
Figure 9:
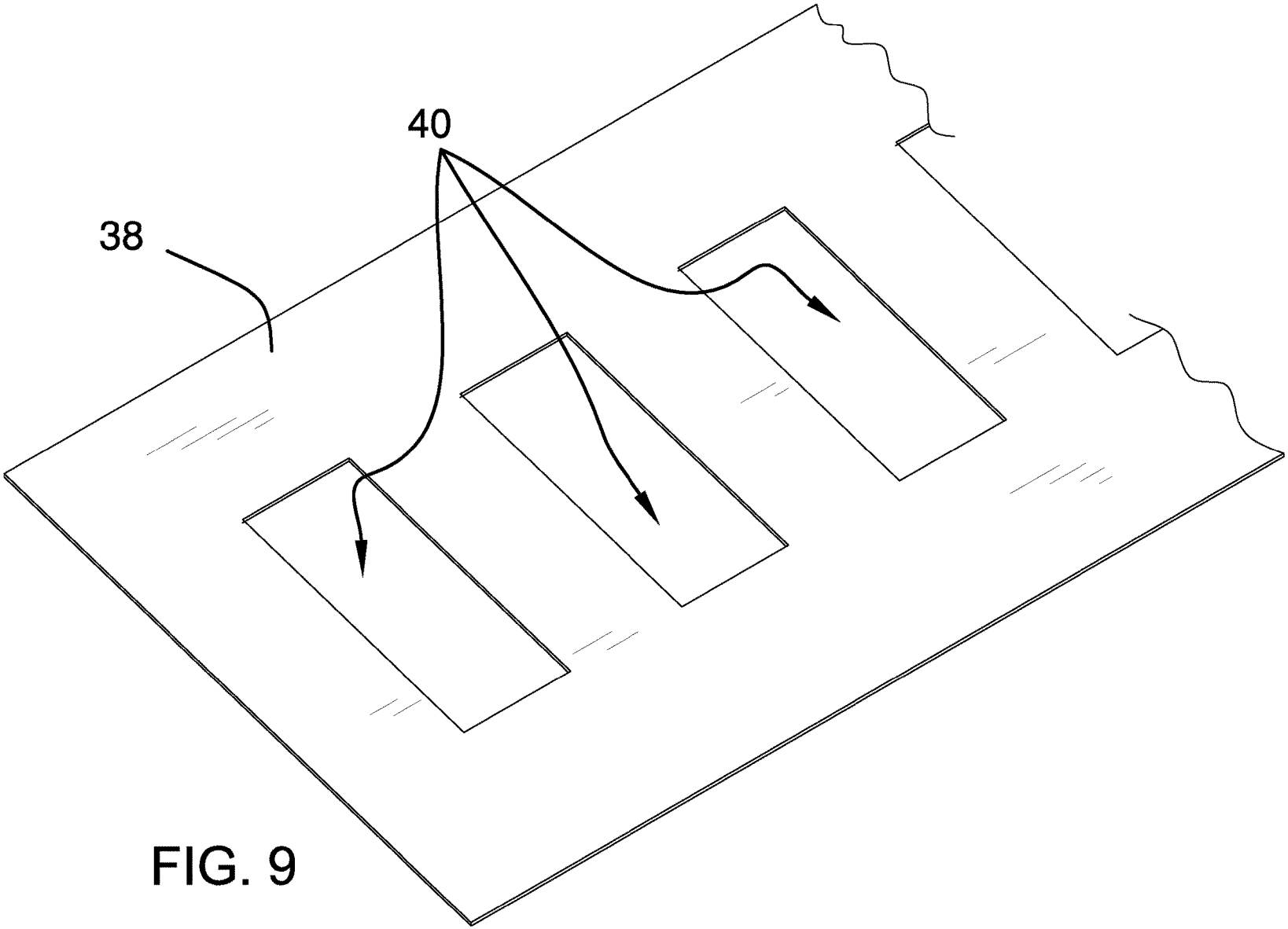
FIG. 9 is a perspective view of a baffle taken from arrow 9 of FIG. 3 of an embodiment of the disclosure.

With reference now to the drawings, and in particular to FIGS. 1 through 9 thereof, a new barrier device embodying the principles and concepts of an embodiment of the disclosure and generally designated by the reference numeral 10 will be described.

As best illustrated in FIGS. 1 through 9, the inflatable water barrier assembly 10 generally comprises a plurality of boundary units 12. Each of the boundary units 12 can be linked together on a support surface 14 to define a boundary around a selected area. Moreover, each of the boundary units 12 can inhibit flood water from entering the selected area. The support surface 14 may be the ground surrounding a house or the like. Additionally, the selected area may be an area surrounding an entry into the house or any other area that needs to be protected from flood waters.

Each of the boundary units 12 has a lower portion 16 that is fluidly discrete from an upper portion 18. The lower portion 16 is fillable with water to weigh down the boundary units 12 thereby inhibiting the boundary units 12 from being moved. The upper portion 18 of each of the boundary units 12 is inflatable with air to inhibit the flood water from passing thereover. Each of the boundary units 12 has a bottom wall 20, a top wall 22 and an outer wall 24 extending therebetween, and the outer wall 24 has a first lateral side 26 and a second lateral side 28. Each of the boundary units 12 is elongated between the first lateral side 26 and the second lateral side 28. The top wall 22 of each of the boundary units 12 has a first half 30 that is oriented at an angle with a second half 32. Moreover, the top wall 22 of each of the boundary units 12 defines a peak 34 extending along a full length of the boundary units 12.

Each of the boundary units 12 has a dividing wall 36 therein. The dividing wall 36 is aligned with an intersection between the top wall 22 and the outer wall 24 to define the upper portion 18 and the lower portion 16 of the boundary units 12. Additionally, the dividing wall 36 extends along an entire length of the respective boundary unit 12. Each of the top wall 22, the bottom wall 20, the outer wall 24 and the dividing wall 36 of each of the boundary units 12 is comprised of a fluid impermeable material.

Each of the boundary units 12 has a pair of baffles 38 each being positioned within the lower portion 16 of a respective one of the boundary units 12. Each of the baffles 38 extends between the first lateral side 26 and the second lateral side 28 of the outer wall 24 of the respective boundary unit 12. Additionally, each of the baffles 38 has a plurality of fluid openings 40 extending therethrough. In this way water pass can pass through the baffles 38 for reducing inertia generated by the water moving in the respective boundary unit 12.

The plurality of boundary units 12 includes a set of corner units 42. The outer wall 24 of each of the corner units 42 has a first half 41 that is oriented at an angle with respect to a second half 43. In this way each of the corner units 42 can define a corner of the boundary around the selected area. Thus, the boundary units 12 and the corner units 42 can be linked together to define a boundary of any rectilinear shape.

A plurality of nipples 44 is provided and each of the nipples 44 is fluidly coupled to a respective one of the boundary units 12. Each of the nipples 44 can be fluidly coupled to a compressed air source. Moreover, each of the nipples 44 is in fluid communication with the upper portion 18 of the respective boundary unit 12 to pass air therethrough for inflating the upper portion 18 of the respective boundary unit 12. Each of the nipples 44 is positioned on the first lateral side 26 of the outer wall 24 of the respective boundary unit 12.

A plurality of first fill spouts 46 is each fluidly coupled to a respective one of the boundary units 12 and each of the first fill spouts 46 can be fluidly coupled to a fluid source. Each of the first fill spouts 46 is in fluid communication with the lower portion 16 of the respective boundary unit 12 for filling the lower portion 16 of the respective boundary unit 12 with water. Each of the first fill spouts 46 is positioned on the first lateral side 26 of the outer wall 24 of the respective boundary unit 12. A plurality of second fill spouts 48 is each fluidly coupled to a respective one of the boundary units 12. The second fill spout 48 on each of the boundary units 12 is fluidly coupled to the first fill spout 46 on an adjacent one of the boundary units 12 when the boundary units 12 are linked together. In this way the second fill spout 48 on each of the boundary units 12 can pass water between the boundary units 12 for filling the linked boundary units 12 with water. Each of the second fill spouts 48 is positioned on the second lateral side 28 of the outer wall 24 of the respective boundary unit 12.

A plurality of first receivers 50 is each coupled to a respective one of the boundary units 12. Each of the first receivers 50 is positioned on the first lateral side 26 of the outer wall 24 of the respective boundary unit 12. A plurality of second receivers 52 is each of the second receivers 52 is coupled to a respective one of the boundary units 12. Each of the second receivers 52 is positioned on the second lateral side 28 of the outer wall 24 of the respective boundary unit 12. Additionally, each of the second receivers 52 is aligned with a respective one of the first receivers 50 on an adjacent one of the boundary units 12 when the boundary units 12 are linked together.

A plurality of clips 54 is provided and each of the clips 54 releasably engages respective ones of the first receiver 50 and the second receiver 52 on a respective pair of the boundary units 12 when the boundary units 12 are linked together. In this way the boundary units 12 can be coupled together. Each of the clips 54 may include a pair of arms 56 being spaced apart from each other and each of the arms 56 may engage the respective first receiver 50 and second receiver 52.

A plurality of anchors 58 is provided and each of the anchors 58 has a respective one of the boundary units 12 being slid therethrough. Each of the anchors 58 penetrates a support surface 14 thereby anchoring the respective boundary unit 12 to the support surface 14. In this way each of the anchors 58 can inhibit the respective boundary unit 12 from is moved by flood water. Each of the anchors 58 has a first lateral wall 60, a second lateral wall 62 and an upper wall 63 extending between the first lateral wall 60 and the second lateral wall 62. The upper wall 63 of each of the anchors 58 has a first half 64 that is oriented at an angle with a second half 65 such that the upper wall 63 of each of the anchors 58 defines a peak 66.

Each of the anchors 58 conforms to the first lateral side 26 and the second lateral side 28 of the outer wall 24 of the respective boundary unit 12 when the anchor is positioned on the respective boundary unit 12. Additionally, the upper wall 63 of each of the anchors 58 conforms to the top wall 22 of the respective boundary unit 12. Each of the anchors 58 includes a pair of pegs 68 each being coupled to and extending downwardly from a respective one of the first lateral wall 60 and the second lateral wall 62 of the anchor. Each of the pegs 68 on each of the anchors 58 penetrates the support surface 14 for anchoring the anchors 58 to the support surface 14.

In use, a selected number of the boundary units 12 are positioned on the ground to define the barrier surrounding the selected area. The boundary units 12 are linked together such that the lower portion 16 of each of the boundary units 12 is in fluid communication with each other. Thus, the lower portion 16 of each of the boundary units 12 is filled with water for weighing down the boundary units 12. The upper portion 18 of each of the boundary units 12 is in fluid communication with each other when the boundary units 12 are linked together. Thus, the upper portion 18 of each of the boundary units 12 can be inflated. The anchors 58 are positioned on respective ones of the boundary units 12 and the pegs 68 on each of the anchors 58 are urged into the support surface 14. In this way the plurality of boundary units 12 are retained in position for inhibiting flood waters from entering the selected area. The plurality of boundary units 12 can be deflated and removed from the support surface 14 when flood waters no longer pose a threat.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An inflatable water barrier assembly being configured to define a boundary to inhibit flood water from entering a selected area, said assembly comprising:

a plurality of boundary units, each of said boundary units linked together on a support surface to define a boundary around a selected area wherein each of said boundary units is configured to inhibit flood water from entering the selected area, each of said boundary units having a lower portion being fluidly discrete from an upper portion, said lower portion being fillable with water wherein each of said boundary units is configured to be weighted down thereby inhibiting said boundary units from being moved, said upper portion of each of said boundary units being inflatable with air wherein each of said boundary units is configured to inhibit the flood water from passing thereover, each of said boundary units having a bottom wall, a top wall and an outer wall extending therebetween, said outer wall having a first lateral side and a second lateral side, each of said boundary units being elongated between said first lateral side and said second lateral side, said top wall of each of said boundary units having a first half being oriented at an angle with a second half such that said top wall of each of said boundary units defines a peak extending along a full length of said boundary units; and a plurality of anchors, each of said anchors having a respective one of said boundary units slid therethrough such that said respective one of said boundary units extends under said anchor, each of said anchors penetrating a support surface thereby anchoring said respective boundary unit to the support surface wherein each of said anchors is configured to inhibit said respective boundary unit from being moved by flood water each of said anchors having a first lateral wall, a second lateral wall positioned parallel to said first lateral wall, and an upper wall extending between said first lateral wall and said second lateral wall, said upper wall of each of said anchors having a first half being oriented at an angle with a second half such that said upper wall of each of said anchors defines a peak, each of said anchors conforming to said first lateral side and said second lateral side of said outer wall of said respective boundary unit, said upper wall of each of said anchors conforming to said top wall of said respective boundary unit, each of said anchors including a pair of pegs, each of said pegs of each of said anchors being coupled to and extending downwardly from a respective one of said first lateral wall and said second lateral wall of said anchor such that said peg is coplanar with said respective one of said first lateral wall and said second lateral wall wherein each of said pegs on each of said anchors is configured for penetrating the support surface for anchoring said anchors to the support surface.

2. The assembly according to claim 1, wherein each of said boundary units has a dividing wall therein, said dividing wall being aligned with an intersection between said top wall and said outer wall to define said upper portion and said lower portion of said boundary units, said dividing wall extending along an entire length of said respective boundary unit.

3. The assembly according to claim 2, wherein each of said top wall, said bottom wall, said outer wall and said dividing wall of each of said boundary units is comprised of a fluid impermeable material.

4. The assembly according to claim 3, wherein each of said boundary units has a pair of baffles each being positioned within said lower portion of a respective one of said boundary units, each of said baffles extending between said first lateral side and said second lateral side of said outer wall of said respective boundary unit, each of said baffles having a plurality of fluid openings extending therethrough wherein each of said baffles is configured to have water pass therethrough for reducing inertia generated by the water moving in said respective boundary unit.

5. The assembly according to claim 4, wherein said plurality of boundary units includes a set of corner units, said outer wall of each of said corner units having a first half being oriented at an angle with respect to a second half thereby facilitating each of said corner units to define a corner of the boundary around the selected area.

6. The assembly according to claim 1, further comprising a plurality of nipples, each of said nipples being fluidly coupled to a respective one of said boundary units wherein each of said nipples is configured to be fluidly coupled to a compressed air source, each of said nipples being in fluid communication with said upper portion of said respective boundary unit wherein each of said nipples is configured to pass air therethrough for inflating said upper portion of said respective boundary unit, each of said nipples is positioned on said first lateral side of said outer wall of said respective boundary unit.

7. The assembly according to claim 1, further comprising a plurality of first fill spouts, each of said first fill spouts being fluidly coupled to a respective one of said boundary units wherein each of said first fill spouts is configured to be fluidly coupled to a fluid source, each of said first fill spouts being in fluid communication with said lower portion of said respective boundary unit for filling said lower portion of said respective boundary unit with water, each of said first fill spouts is positioned on said first lateral side of said outer wall of said respective boundary unit.

8. The assembly according to claim 7, further comprising a plurality of second fill spouts, each of said second fill spouts being fluidly coupled to a respective one of said boundary units, said second fill spout on each of said boundary units being fluidly coupled to said first fill spout on an adjacent one of said boundary units when said boundary units are linked together wherein said second fill spout on each of said boundary units is configured to pass water between said boundary units for filling said linked boundary units with water, each of said second fill spouts is positioned on said second lateral side of said outer wall of said respective boundary unit.

9. The assembly according to claim 1, further comprising a plurality of first receivers, each of said first receivers being coupled to a respective one of said boundary units, each of said first receivers being positioned on said first lateral side of said outer wall of said respective boundary unit.

10. The assembly according to claim 9, further comprising a plurality of second receivers, each of said second receivers being coupled to a respective one of said boundary units, each of said second receivers being positioned on said second lateral side of said outer wall of said respective boundary unit, each of said second receivers being aligned with a respective one of said first receivers on an adjacent one of said boundary units when said boundary units are linked together.

11. The assembly according to claim 10, further comprising a plurality of clips, each of said clips releasably engaging respective ones of said first receiver and said second receiver on a respective pair of said boundary units when said boundary units are linked together for coupling said boundary units together.

12. An inflatable water barrier assembly being configured to define a boundary to inhibit flood water from entering a selected area, said assembly comprising:

a plurality of boundary units, each of said boundary units linked together on a support surface to define a boundary around a selected area wherein each of said boundary units is configured to inhibit flood water from entering the selected area, each of said boundary units having a lower portion being fluidly discrete from an upper portion, said lower portion being fillable with water wherein each of said boundary units is configured to be weighted down thereby inhibiting said boundary units from being moved, said upper portion of each of said boundary units being inflatable with air wherein each of said boundary units is configured to inhibit the flood water from passing thereover, each of said boundary units having a bottom wall, a top wall and an outer wall extending therebetween, said outer wall having a first lateral side and a second lateral side, each of said boundary units being elongated between said first lateral side and said second lateral side, said top wall of each of said boundary units having a first half being oriented at an angle with a second half such that said top wall of each of said boundary units defines a peak extending along a full length of said boundary units, each of said boundary units having a dividing wall therein, said dividing wall being aligned with an intersection between said top wall and said outer wall to define said upper portion and said lower portion of said boundary units, said dividing wall extending along an entire length of said respective boundary unit, each of said top wall, said bottom wall, said outer wall and said dividing wall of each of said boundary units being comprised of a fluid impermeable material, each of said boundary units having a pair of baffles each being positioned within said lower portion of a respective one of said boundary units, each of said baffles extending between said first lateral side and said second lateral side of said outer wall of said respective boundary unit, each of said baffles having a plurality of fluid openings extending therethrough wherein each of said baffles is configured to have water pass therethrough for reducing inertia generated by the water moving in said respective boundary unit, said plurality of boundary units including a set of corner units, said outer wall of each of said corner units having a first half being oriented at an angle with respect to a second half thereby facilitating each of said corner units to define a corner of the boundary around the selected area;

a plurality of nipples, each of said nipples being fluidly coupled to a respective one of said boundary units wherein each of said nipples is configured to be fluidly coupled to a compressed air source, each of said nipples being in fluid communication with said upper portion of said respective boundary unit wherein each of said nipples is configured to pass air therethrough for inflating said upper portion of said respective boundary unit, each of said nipples being positioned on said first lateral side of said outer wall of said respective boundary unit;

a plurality of first fill spouts, each of said first fill spouts being fluidly coupled to a respective one of said boundary units wherein each of said first fill spouts is configured to be fluidly coupled to a fluid source, each of said first fill spouts being in fluid communication with said lower portion of said respective boundary unit for filling said lower portion of said respective boundary unit with water, each of said first fill spouts being positioned on said first lateral side of said outer wall of said respective boundary unit;

a plurality of second fill spouts, each of said second fill spouts being fluidly coupled to a respective one of said boundary units, said second fill spout on each of said boundary units being fluidly coupled to said first fill spout on an adjacent one of said boundary units when said boundary units are linked together wherein said second fill spout on each of said boundary units is configured to pass water between said boundary units for filling said linked boundary units with water, each of said second fill spouts being positioned on said second lateral side of said outer wall of said respective boundary unit;

a plurality of first receivers, each of said first receivers being coupled to a respective one of said boundary units, each of said first receivers being positioned on said first lateral side of said outer wall of said respective boundary unit;

a plurality of second receivers, each of said second receivers being coupled to a respective one of said boundary units, each of said second receivers being positioned on said second lateral side of said outer wall of said respective boundary unit, each of said second receivers being aligned with a respective one of said first receivers on an adjacent one of said boundary units when said boundary units are linked together;

a plurality of clips, each of said clips releasably engaging respective ones of said first receiver and said second receiver on a respective pair of said boundary units when said boundary units are linked together for coupling said boundary units together;

a plurality of anchors, each of said anchors having a respective one of said boundary units slid therethrough, each of said anchors penetrating a support surface thereby anchoring said respective boundary unit to the support surface wherein each of said anchors is configured to inhibit said respective boundary unit from being moved by flood water, each of said anchors having a first lateral wall, a second lateral wall positioned parallel to said first lateral wall, and an upper wall extending between said first lateral wall and said second lateral wall, said upper wall of each of said anchors having a first half being oriented at an angle with a second half such that said upper wall of each of said anchors defines a peak, each of said anchors conforming to said first lateral side and said second lateral side of said outer wall of said respective boundary unit, said upper wall of each of said anchors conforming to said top wall of said respective boundary unit, each of said anchors including a pair of pegs, each of said pegs of each of said anchors being coupled to and extending downwardly from a respective one of said first lateral wall and said second lateral wall of said anchor such that said peg is coplanar with said respective one of said first lateral wall and said second lateral wall wherein each of said pegs on each of said anchors is configured for penetrating the support surface for anchoring said anchors to the support surface.

* * * * *